US005690128A

United States Patent [19]

Grimes

[11] Patent Number: 5,690,128

[45] Date of Patent: Nov. 25, 1997

[54] DECORATIVE HAIR STYLING AND RETAINING ACCESSORY

[76] Inventor: Kristina M. Grimes, 12720 Dulcinea Pl., Lakeridge, Va. 22192

[21] Appl. No.: 688,411

[22] Filed: Jul. 30, 1996

[51] Int. Cl.[6] ..... A45D 24/04

[52] U.S. Cl. ..... 132/128; 132/275

[58] Field of Search ..... 132/212, 219, 132/126, 128, 144, 148, 273, 275

[56] References Cited

U.S. PATENT DOCUMENTS

| | | | |
|---|---|---|---|
| Re. 16,546 | 2/1927 | Parker . | |
| 852,273 | 4/1907 | Hess . | |
| 953,587 | 3/1910 | Bond, Jr. . | |
| 961,323 | 6/1910 | Stacy . | |
| 966,113 | 8/1910 | McCall . | |
| 1,533,380 | 4/1925 | Burkhart . | |
| 1,594,741 | 8/1926 | Lewis . | |
| 1,635,065 | 7/1927 | Watson . | |
| 1,652,462 | 12/1927 | Stephens | 132/273 |
| 1,665,380 | 4/1928 | Ruffio . | |
| 1,803,026 | 4/1931 | Lorenz . | |
| 1,823,361 | 9/1931 | Hudson . | |
| 2,139,106 | 12/1938 | Solomon . | |
| 5,174,312 | 12/1992 | Adams | 132/273 |
| 5,379,782 | 1/1995 | Tabb . | |
| 5,441,061 | 8/1995 | Jordan et al. . | |
| 5,494,059 | 2/1996 | Barrows et al. . | |

FOREIGN PATENT DOCUMENTS

| | | | |
|---|---|---|---|
| 0025633 | 9/1902 | Switzerland | 132/273 |
| 10819 | of 1896 | United Kingdom | 132/128 |

*Primary Examiner*—Jeffrey A. Smith
*Attorney, Agent, or Firm*—Dennis H. Lambert

[57] ABSTRACT

A decorative hair styling and retaining accessory for holding the wearer's hair in place. The accessory includes at least one elastic member concealed within a decorative cover, and a comb attached at each end of the elastic member for attaching the accessory to the wearer's hair. The cover may be provided with a variety of decorative themes, and the combs are readily removable from the elastic member to enable the cover to be cleaned.

5 Claims, 5 Drawing Sheets

FIG. 8
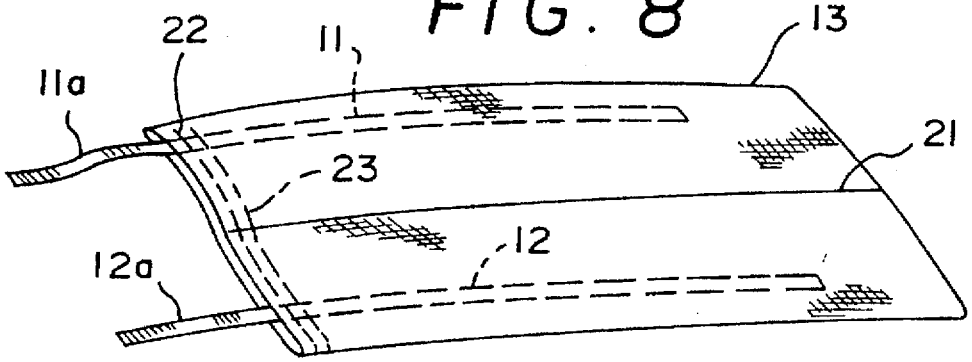
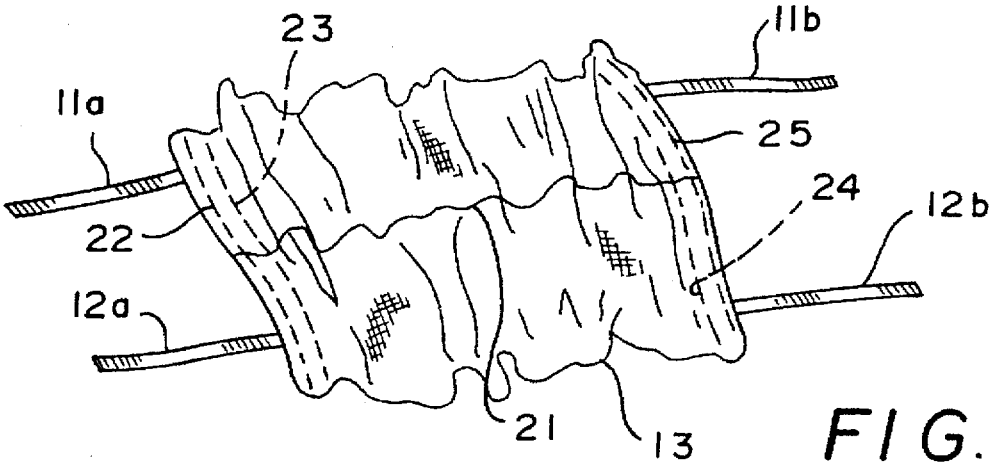
FIG. 9
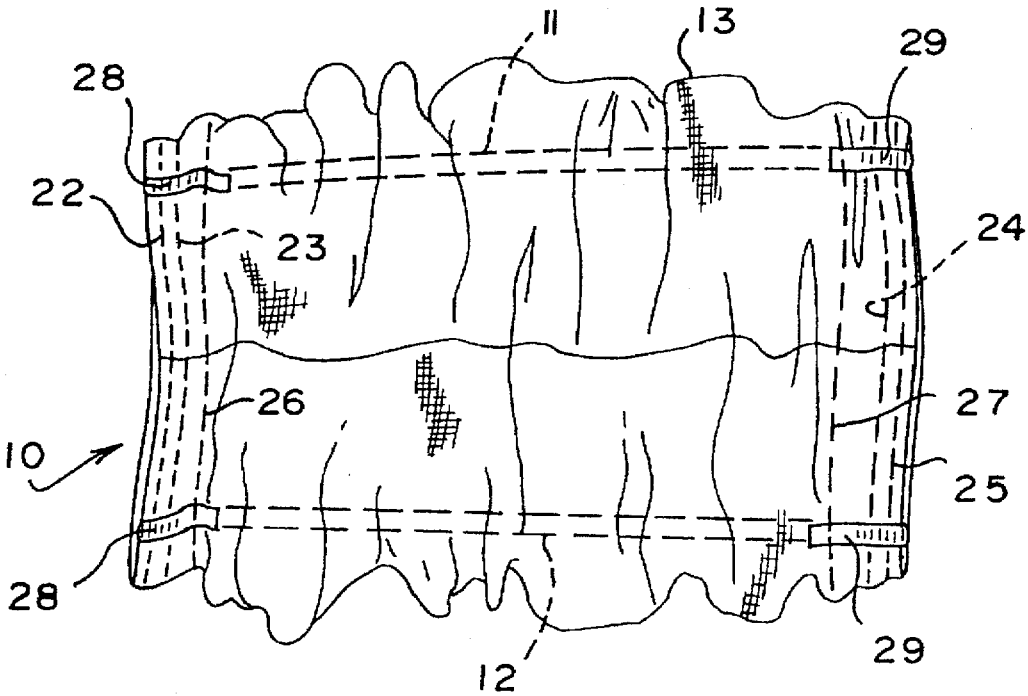
FIG. 10

DECORATIVE HAIR STYLING AND RETAINING ACCESSORY

BACKGROUND OF THE INVENTION

1. Field Of The Invention

This invention relates to personal grooming devices, and more particularly, to a hairstyling and retaining accessory.

2. Description Of The Prior Art

A variety of hairstyling and retaining devices have been in use for many years, including bobby pins, hair clips or barrettes, combs and elastic bands.

Some hairstyling and retaining devices used in the prior art include combinations of combs and ties or elastic members, with or without decorative features. Examples of the latter are found in U.S. Pat. Nos. 184,793 (Morse), 1,540,102 (Cohen), 1,549,334 (Ruffio), and 2,386,682 (Heineman). The Cohen device includes a relatively stiff net-like center portion 5 connected to a pair of combs 6 by elastic members 7. Artificial hair may be woven into the net-like center portion so that when the combs are inserted into the wearer's hair, the artificial hair may be attached to the natural hair of the wearer and arranged into a desired style. The Ruffio device is similar in that it includes a pair of net-like portions 12 connected together by an elastic member 13, and having hair pins or combs attached at the outer ends for securing the device in the hair of the wearer. Tufts of hair 15 are carried by the net-like portions 12 and may be styled to give the appearance of long hair.

The patent to Morse discloses a pair of combs connected together by elastic bands, and apparently may be inserted in the wearer's hair to retain the hair in place, although the specific manner of use is not described.

The patent to Heineman discloses a device for holding the wearer's hair, and comprises an elongate open-weave net-like center portion folded to define a pocket 6, and having attaching means such as combs at its opposite ends. In use, the wearer's hair is gathered and placed in the pocket 6 so that it may be held as illustrated in FIG. 5.

The devices described above are relatively limited in their use, serving only to hold or retain the hair in a particular way (Morse and Heineman), or to provide a variety of hairstyles utilizing artificial hair which may be styled to give a desired appearance.

Persons with long hair frequently wear their hair in a variety of styles, including a French twist or French braid, ponytail, folded into a bun at the back of the head, or swept back at the sides and held in a fall at the back of the head, for example. Numerous devices are available for holding the hair swept back, including hair barrettes or clips, or combs which are inserted into the hair at opposite sides of the back of the wearer's head. However, the manner of use and the variety of styles available with these prior art devices are limited. Moreover, individual combs or bobby pins and similar devices may not remain securely fastened in the hair, requiring frequent adjustment or reattachment. Other devices are relatively heavy and uncomfortable to wear, or are unsightly in appearance.

Accordingly, there is need for a hairstyling and retaining device that it is simple and lightweight in construction and which is decorative and may be used to secure the hair of the wearer in a variety of styles.

SUMMARY OF THE INVENTION

An object of the invention is, therefore, to provide a hairstyling and retaining accessory which is lightweight and comfortable to wear and is simple to use to retain the wearer's hair in a variety of hairstyles.

Another object of the invention is to provide a hairstyling and retaining accessory that is elastically yieldable to provide secure support for a variety of hairstyles and to enable it to adapt to a variety of different sizes. Further, the accessory of the invention has easily detachable combs to facilitate cleaning of it.

To meet the foregoing as well as other objects of the invention, elastic means is covered with a decorative cover and secured at its opposite ends to attaching means such as combs, whereby the combs may be inserted into the wearer's hair at different locations and the elastic means and decorative cover extended between the two combs in retaining relationship over the hair of the wearer to hold the hair in a desired style. The decorative cover may comprise a piece of fabric that is gathered or bunched when the elastic means is at rest, whereby the cover can expand to accommodate elongation of the elastic means. The fabric may have any suitable design or pattern, including collegiate motifs, or dressy themes such as a sequined material.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein:

FIG. 8 is a perspective view of the accessory of FIG. 7, after the fabric has been turned inside out, to enclose a substantial portion of the length of the elastic members;

FIG. 9 is a perspective view of the accessory of FIG. 8, showing the fabric being gathered or bunched relative to the elastic members;

FIG. 10 is a plan view of the accessory device of FIG. 9, with opposite ends of the fabric stitched and closed to the elastic members, and the opposite ends of the elastic members folded over and stitched to the fabric to form loops;

DETAILED DESCRIPTION OF THE PREFERRED EMBODIMENTS

Figure 1:
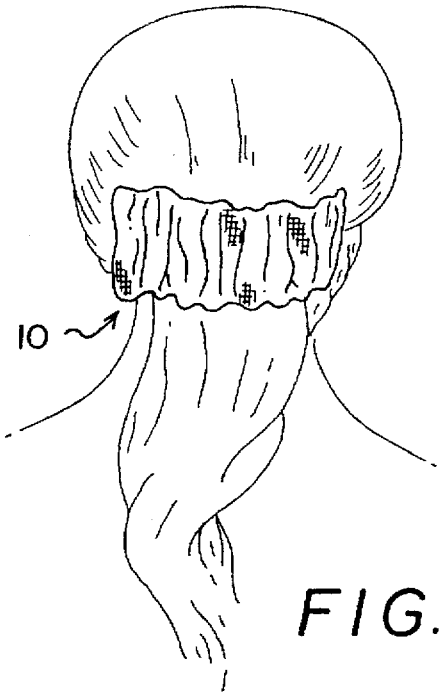
FIG. 1 is a rear view in elevation of a person wearing the decorative hairstyling and retaining accessory of the invention, applied in one possible way to the hair of a wearer.

Referring more specifically to the drawings, the hairstyling and retaining accessory of the invention is indicated generally at 10, and includes a pair of elongate elastic members 11 and 12 enclosed in a decorative cover 13 and attached at their opposite ends to a pair of combs 14 and 15. Opposite ends of the decorative cover 13 are stitched closed and to the respective opposite ends of the elastic bands 11 and 12, with the opposite ends of the elastic bands folded over and stitched to form loops which removably hold the combs in place. The covering is gathered or bunched with the elastic bands in their relaxed or at-rest condition, so that the cover can accommodate expansion or stretching of the elastic bands.

The combs 14 and 15 may be of any suitable construction, including those commercially available, although in a preferred construction they are curved or arcuately shaped and include a back or base member 16 with a plurality of elongate parallel teeth 17 extending from one side thereof. The curved or arcuate design of the combs enables them to more comfortably and better fit the head of the wearer. In use, the combs are folded rearwardly behind the elastic members and cover, with the concave side of the curved combs facing the head of the wearer. Thus, after the combs are inserted into the hair of the wearer, neither they nor the elastic members are visible and only the cover can be seen. The cover can be made decorative to achieve a desired appearance.

Figure 6:
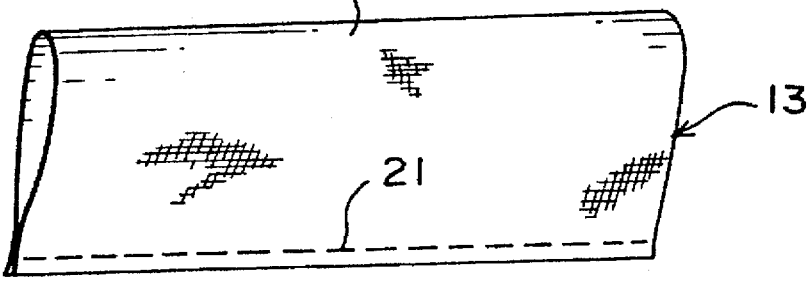
FIG. 6 is a perspective view of the fabric of FIG. 5, folded to a first position for stitching.

Details of construction of the hair styling and retaining accessory of the invention are best seen in FIGS. 5–14. The cover 13 is formed from a flat sheet of material 20 that is folded upon itself as illustrated in FIG. 6 and stitched along one side at 21 to form an elongate rectangularly shaped sleeve. In a preferred construction, the flat sheet of material 20 is initially approximately 13" long and 7.5" wide.

Figure 7:
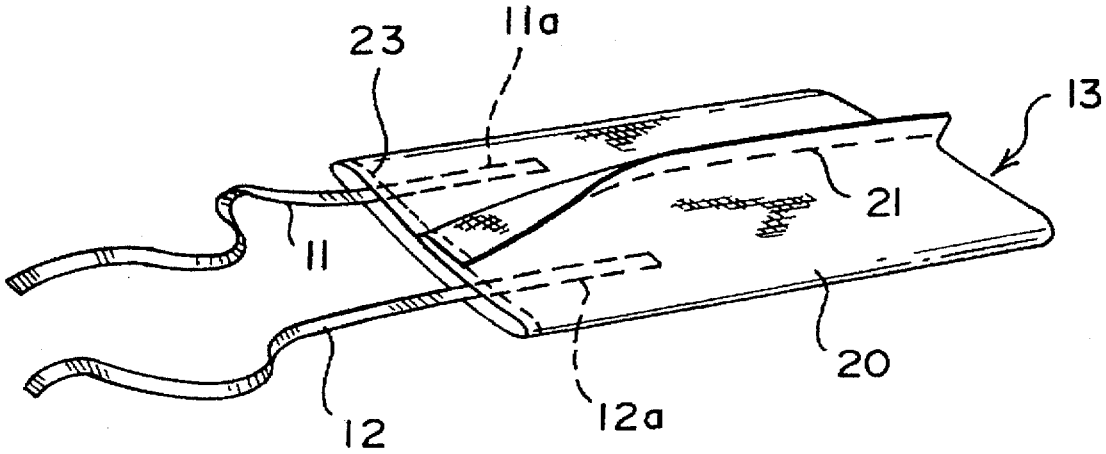
FIG. 7 is a perspective view of the folded and stitched fabric of FIG. 6, with a pair of elastic members inserted into the pocket defined by the folded fabric, and one end closed by a line of stitching.
Figure 11:
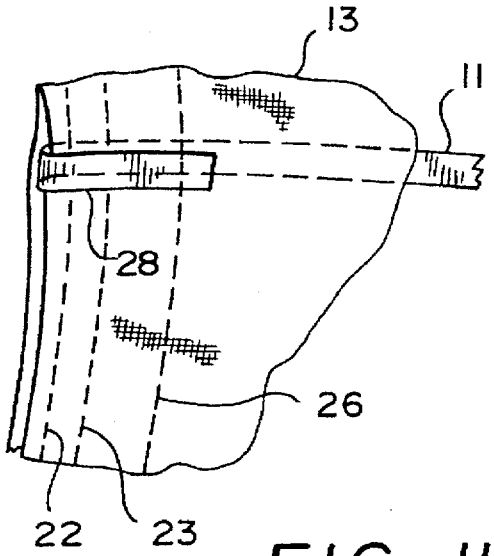
FIG. 11 is a an enlarged fragmentary perspective view of a portion of the accessory of FIG. 10, showing the looped ends of the elastic members.
Figure 12:
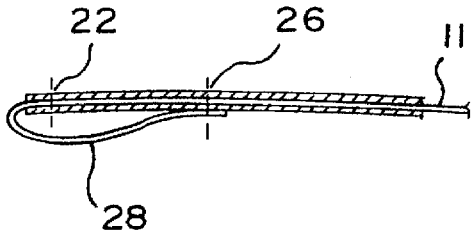
FIG. 12 is a somewhat schematic sectional view of the accessory, illustrating how the elastic members are received between the two layers of material forming the decorative cover and looped and stitched thereto.
Figure 13:
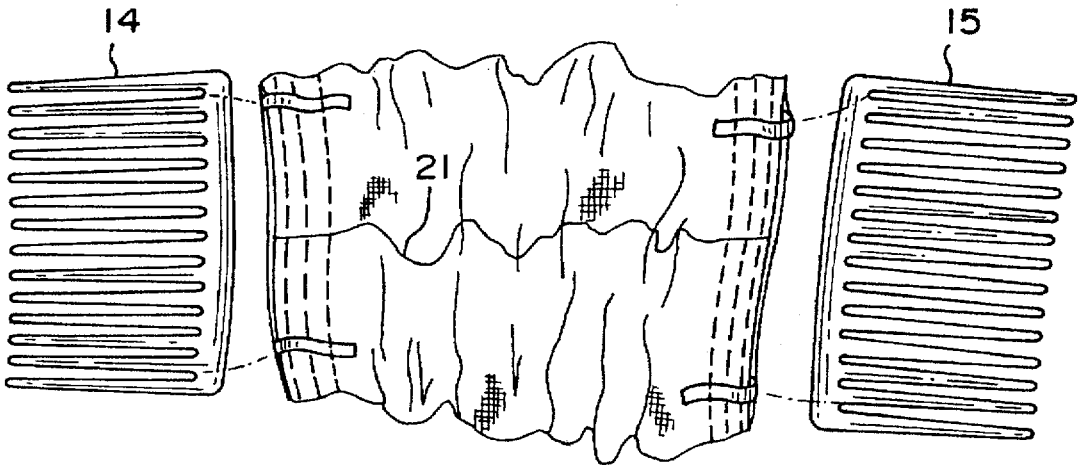
FIG. 13 is an exploded plan view of the decorative cover and elastic members of FIG. 10, showing a pair of combs for attachment to the looped ends of the elastic members.
Figure 14:
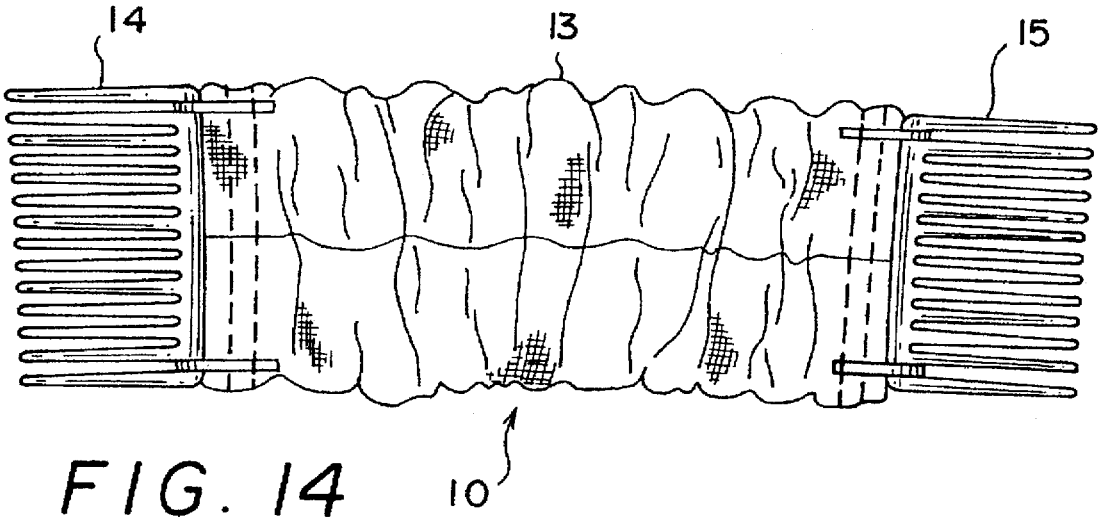
FIG. 14 is a plan view of the decorative cover and the elastic members of FIG. 13, with the combs attached to the looped ends of the elastic members.

The folded over and stitched sheet of fabric 20 is then oriented so that the seam 21 extends along approximately the middle of one surface or face of the folded sheet, and the pair of elongate elastic members 11 and 12 are inserted into one open end of the sleeve as illustrated in FIG. 7. A single row of stitching 22 is then placed across that end of the cover 13 closely adjacent the free edge, to close the end and stitch the cover to the elastic members 11 and 12. The inserted ends 11*a* and 12*a*, respectively, each extend into the pocket approximately 1" beyond the line of stitching.

The sleeve formed by the folded over sheet of material is then turned inside-out so that the elastic members 11 and 12 are enclosed within the sleeve and the ends 11*a* and 12*a* project beyond the end closed by the line of stitching 22. Also, the raw end edge 23 of the sleeve is disposed inwardly of the sleeve, thereby forming a finished end edge on the sleeve. See FIG. 8.

The material forming the cover 13 is then gathered or bunched as depicted in FIG. 9, so that the opposite ends 11*b* and 12*b*, respectively, are exposed at the other end of the cover or sleeve 13. The free end edge of the gathered sleeve is then folded inwardly at 24, and a single line of stitching 25 is placed along that end of the cover to close that end and stitch the cover to the elastic members 11 and 12, with the ends 11*b* and 12*b* projecting beyond the end of the cover approximately 1".

The ends 11*a*, 11*b* and 12*a*, 12*b* are then folded inwardly over the cover 13 and second lines of stitching 26 and 27, respectively, are applied along the opposite ends of the cover, spaced inwardly from the first lines of stitching 22 and 25, to secure the folded over ends of the elastic members to the cover to thus form closed loops 28 and 29.

Figure 15:
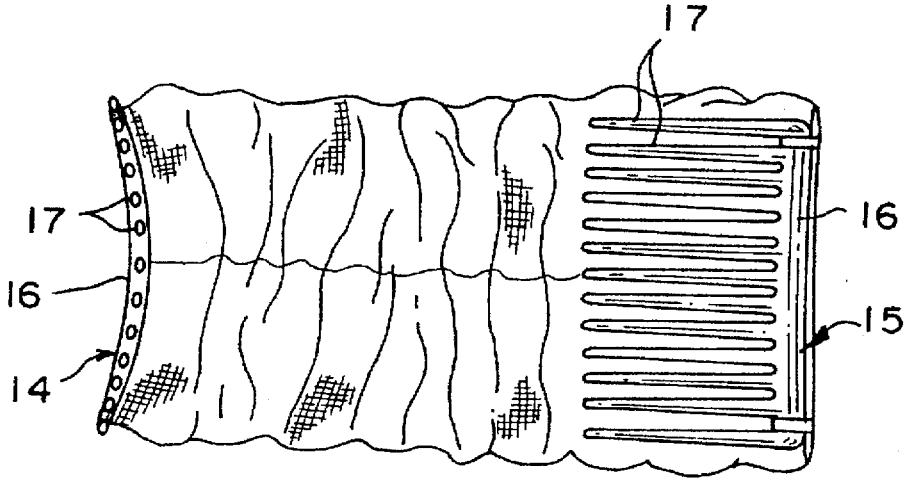
FIG. 15 is a rear plan view of the accessory of FIG. 14, showing one comb folded inwardly and the opposite comb in an intermediate position.
Figure 16:
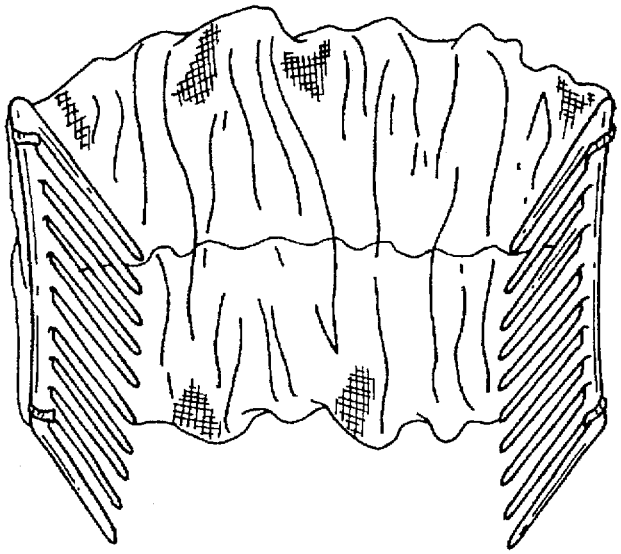
FIG. 16 is a rear perspective view of the accessory of the invention, showing the combs partially folded inwardly ready for application to the hair of the wearer.

The combs 14 and 15 are then assembled to the looped ends 28 and 29 by inserting the end-most teeth on each comb under the respective loops 28 and 29. The combs should be assembled to the loops so that the outwardly bowed or convex side of the combs is oriented toward that side of the covering which has the seam 21 and on which the loops 28 and 29 are formed. This comprises the rear or unfinished side of the cover. Thus, when the combs are folded inwardly as depicted in FIGS. 15 and 16, they are completely obscured from view when the accessory is worn, and the convex curved side of the combs is positioned toward the head of the wearer.

It should be noted that the elastic members 11 and 12 should have a length of approximately 8" in the specific construction described above, and may have any suitable width, i.e., about 0.25". Thus, the overall length of the finished product, not counting the combs, is approximately 5" when the elastic members are in their relaxed or at-rest condition. However, the accessory will stretch to a length of approximately 9", not counting the combs.

The cover 13 may comprise any suitable material, such as fabric or leather and the like, and may have any suitable design or pattern applied to it.

Figure 2:
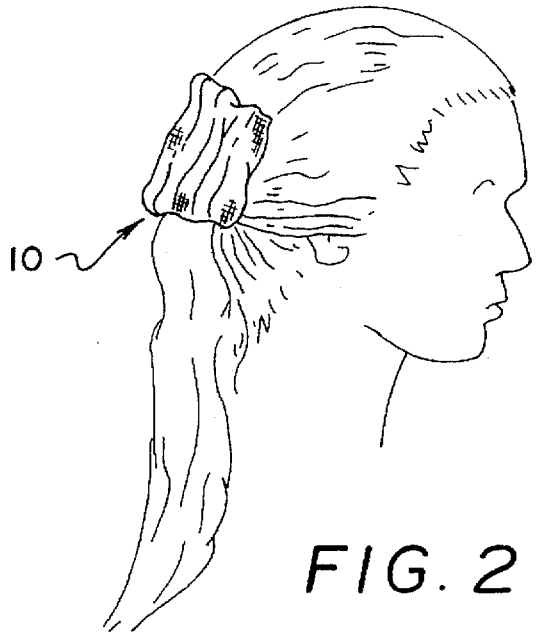
FIG. 2 is a side view in elevation of a person wearing the decorative hairstyling and retaining accessory of the invention, used as shown in FIG. 1.
Figure 3:
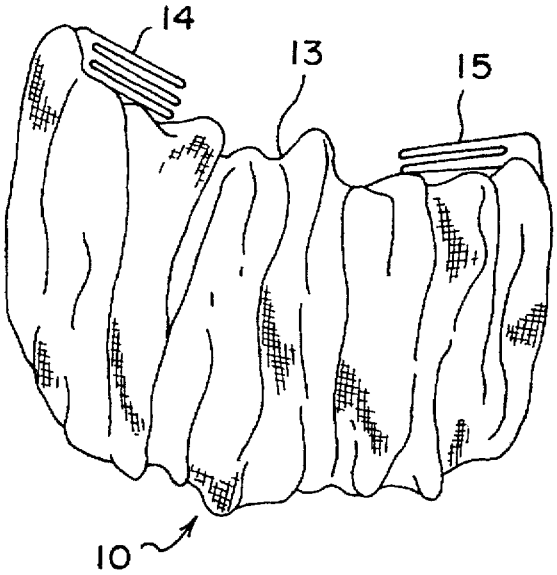
FIG. 3 is a rear perspective view thereof.
Figure 4:
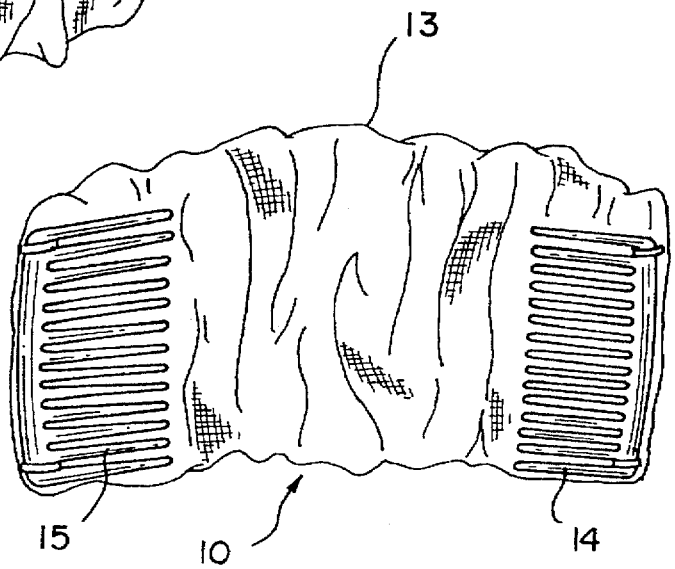
FIG. 4 is front perspective view thereof.
Figure 5:
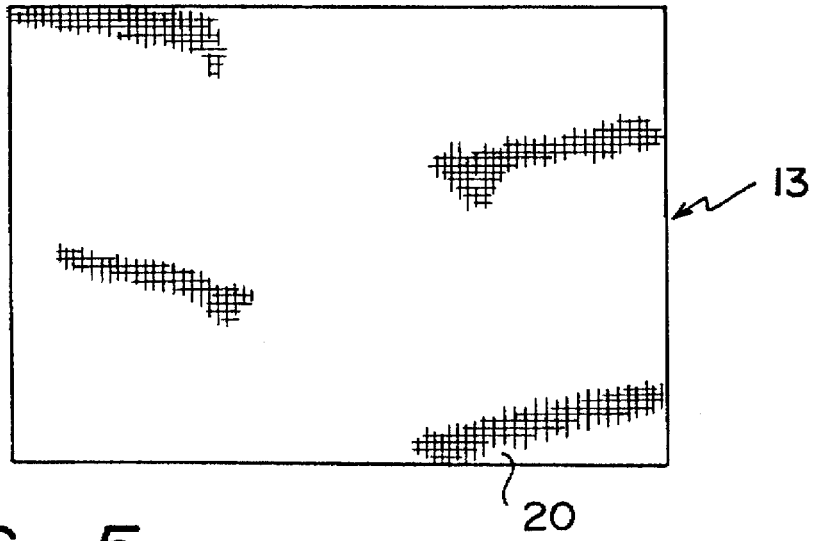
FIG. 5 is a plan view of a piece of fabric prepatory to forming the hairstyling and retaining accessory of the invention.

Further, although the accessory of the invention is shown in FIGS. 1 and 2 as being used to pull the hair back to the rear of the head of the user and hold it so that it falls down the back of the wearer, the hair may be gathered in a bun or twist or other style and the accessory of the invention applied to hold it in place. Thus, the accessory of the invention has great versatility and provides a decorative device for styling and holding in place the hair of the wearer.

While particular embodiments of the invention have been illustrated and described in detail herein, it should be understood that various changes and modifications may be made to the invention without departing from the spirit and intent of the invention as defined by the scope of the appended claims.

What is claimed is:

1. A decorative hair styling and retaining accessory, comprising;

a pair of elongate, spaced apart elastic bands having opposite ends;

a decorative cover enclosing the elastic bands and capable of expanding and contracting with the elastic bands;

a pair of combs each having opposite side edges removably attached to respective opposite ends of the elastic bands, whereby the hair of the wearer may be gathered in a desired style and the combs inserted into the wearer's hair in opposed relationship toward one another on opposite sides of the gathered hair, with the elastic bands and decorative cover extending across the gathered hair to hoist it in place and to provide a decorative accessory; and the opposite ends of the elastic bands formed into loops and an end-most tooth at each side edge of each comb received in the loops of the respective elastic bands to releasably hold the combs to the elastic bands.

2. An accessory as claimed in claim 1, wherein:

the decorative cover comprises a fabric material folded on itself and stitched together along a longitudinal seam to form a tubular sleeve in which the elastic bands are concealed.

3. An accessory as claimed in claim 2, wherein:

the combs are curved so as to define a convex surface and a concave surface, the concave surface being oriented toward the wearer's head when in use.

4. An accessory as claimed in claim 2, wherein:

the ends of the sleeve are stitched closed and to the elastic bands adjacent opposite ends of the bands.

5. An accessory as claimed in claim 4, wherein:

the fabric cover is gathered or bunched prior to being stitched to the elastic bands so that it is expandable upon expansion of the elastic bands.

* * * * *